US009131580B2

(12) United States Patent
Lee et al.

(10) Patent No.: US 9,131,580 B2
(45) Date of Patent: Sep. 8, 2015

(54) BACKLIGHT DRIVING CIRCUIT AND BACKLIGHT DRIVING CIRCUIT

(71) Applicant: Wistron Corp., New Taipei (TW)

(72) Inventors: Hsin-Chun Lee, New Taipei (TW); Peilin Chen, New Taipei (TW); Shou-Jung Chang, New Taipei (TW)

(73) Assignee: WISTRON CORP., New Taipei (TW)

( * ) Notice: Subject to any disclaimer, the term of this patent is extended or adjusted under 35 U.S.C. 154(b) by 311 days.

(21) Appl. No.: 13/772,919

(22) Filed: Feb. 21, 2013

(65) Prior Publication Data

US 2014/0035466 A1 Feb. 6, 2014

(30) Foreign Application Priority Data

Aug. 6, 2012 (TW) ..... 101128188 A

(51) Int. Cl.
*H05B 37/02* (2006.01)
*H05B 33/08* (2006.01)
*G09G 3/00* (2006.01)

(52) U.S. Cl.
CPC ..... *H05B 33/0854* (2013.01); *G09G 3/00* (2013.01)

(58) Field of Classification Search
None
See application file for complete search history.

(56) References Cited

U.S. PATENT DOCUMENTS

| | | | | |
|---|---|---|---|---|
| 7,961,180 | B2 | 6/2011 | Kim | |
| 8,242,716 | B2 * | 8/2012 | Je et al. | 315/312 |
| 8,816,954 | B2 * | 8/2014 | Shin et al. | 345/102 |
| 2011/0157246 | A1 * | 6/2011 | Jang | 345/690 |

* cited by examiner

*Primary Examiner* — Long Nguyen
(74) *Attorney, Agent, or Firm* — Birch, Stewart, Kolasch & Birch, LLP

(57) ABSTRACT

The present invention discloses a backlight driving circuit applied to an electronic device. The backlight driving circuit includes a light-emitting diode unit, a photosensitive element, and a control circuit. The light-emitting diode unit has an anode terminal and a cathode terminal. The photosensitive element is coupled between the cathode terminal of the light-emitting diode unit and a ground, wherein the resistance of the photosensitive element changes with the ambient light level around the electronic device. The control circuit includes a sensing terminal and an output terminal. The sensing terminal receives a feedback voltage. The output terminal provides a power source to the anode terminal of the light-emitting diode unit according to the feedback voltage to control the luminance of the light-emitting diode unit, wherein the feedback voltage is decided by the resistance of the photosensitive element.

10 Claims, 4 Drawing Sheets

BACKLIGHT DRIVING CIRCUIT AND BACKLIGHT DRIVING CIRCUIT

CROSS REFERENCE TO RELATED APPLICATIONS

This application claims priority of Taiwan Patent Application No. 101128188, filed on Aug. 6, 2012, the entirety of which is incorporated by reference herein.

BACKGROUND OF THE INVENTION

1. Field of the Invention

The present invention relates to a backlight driving circuit, and in particular relates to a backlight driving circuit which can automatically adjust the luminance according to the ambient light level.

2. Description of the Related Art

The development of electronic devices such as mobile phones is increasing rapidly. Typically, in a place with high luminance such as under intense sunlight, images, particularly color images, on the display of a portable device like a mobile phone can be difficult for the user to see. The user may need to adjust the backlight or move to a more suitable location. Adjusting the backlight or moving to another location may sometimes be inconvenient for the user. Moreover, the electronic apparatus used indoors will likewise experience the same problems due to changes in indoor lighting.

BRIEF SUMMARY OF THE INVENTION

A detailed description is given in the following embodiments with reference to the accompanying drawings.

The present invention discloses a backlight driving circuit applied to an electronic device. The backlight driving circuit includes a light-emitting diode unit, a photosensitive element, and a control circuit. The light-emitting diode unit has an anode terminal and a cathode terminal, wherein the light-emitting diode unit comprises at least one light-emitting diode. The photosensitive element is arranged to be coupled between the cathode terminal of the light-emitting diode unit and a ground, wherein the resistance of the photosensitive element changes with the ambient light level around the electronic device. The control circuit includes a sensing terminal and an output terminal. The sensing terminal is arranged to receive a feedback voltage. The output terminal is arranged to provide a power source to the anode terminal of the light-emitting diode unit according to the feedback voltage to control the luminance of the light-emitting diode unit, wherein the feedback voltage is decided by the resistance of the photosensitive element.

Additionally, the present invention further discloses a backlight driving method applied to an electronic device. The backlight driving method includes: providing a power source to the anode terminal of a light-emitting diode unit; detecting the ambient light level around the electronic device by a photosensitive element, wherein the photosensitive element is arranged to be coupled between the cathode terminal of the light-emitting diode unit and a ground, and the resistance of the photosensitive element changes with the ambient light level around the electronic device; and adjusting the power source to control the luminance of the light-emitting diode unit according to a feedback voltage received by a sensing terminal, wherein the sensing terminal is arranged to be coupled to the cathode terminal of the light-emitting diode unit, and the feedback voltage is decided by the resistance of the photosensitive element.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
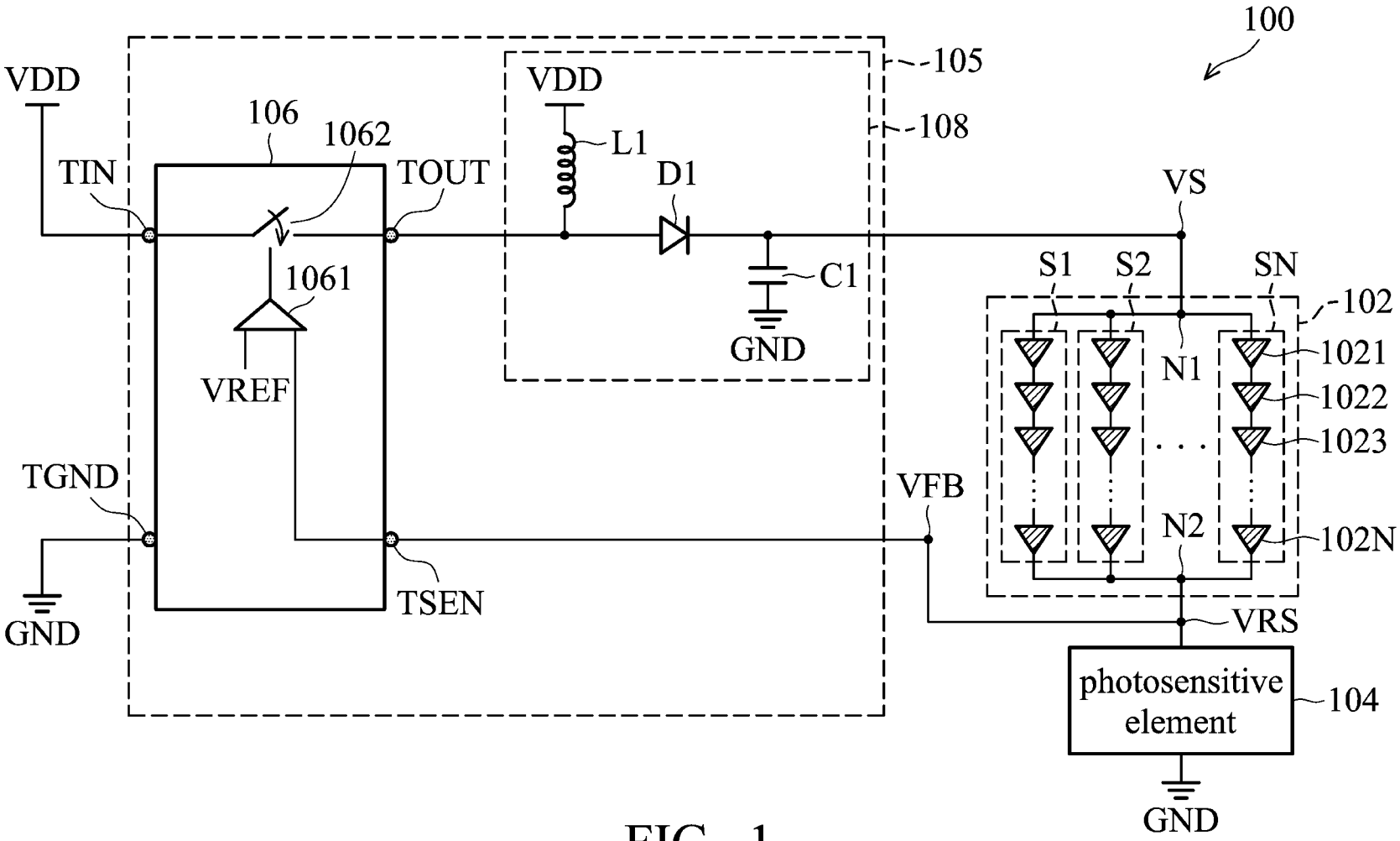
FIG. 1 is a schematic diagram illustrating an embodiment of a backlight driving circuit of the present invention.

FIG. 1 is a schematic diagram illustrating an embodiment of a backlight driving circuit of the present invention. The backlight driving circuit 100 can be applied to an electronic device (not shown), such as a telephone, cell phone, tablet, or notebook computer with a backlight module, but it is not limited thereto. Moreover, the backlight driving circuit 100 can detect the luminance of the ambient light level around the electronic device and adjust the luminance of backlight according to the detected ambient light level.

The backlight driving circuit 100 includes a light-emitting diode unit 102, a photosensitive element 104 and a control circuit 105. The light-emitting diode unit 102 has an anode terminal N1 and a cathode terminal N2, wherein the light-emitting diode unit 102 includes a plurality of series units S1-SN. The series units S1-SN are arranged to be connected between the anode terminal N1 and the cathode terminal N2 of the light-emitting diode unit 102 in parallel. Each of the series units S1-SN has a plurality of light-emitting diodes 1021-102N. Each of the light-emitting diodes 1021-102N has a cathode and an anode, wherein the light-emitting diodes 1021-102N are connected with each other in the same direction in parallel. The anodes of the first light-emitting diodes 1021 of each of the series units S1-SN are arranged to be connected to the anode terminal N1, and the cathode of the last light-emitting diodes 102N of each of the series units S1-SN are arranged to be connected to the cathode terminal N2. In some embodiments, the light-emitting diode unit 102 can only include one series unit, but it is not limited thereto. In some other embodiments, the series unit can only include a light-emitting diode, but it is not limited thereto.

The photosensitive element 104 is arranged to be coupled between the cathode terminal N2 of the light-emitting diode unit 102 and a ground GND, wherein the resistance of the photosensitive element 104 changes with the ambient light level around the electronic device (not shown). For example, the photosensitive element 104 can be a photosensitive resistor, photosensitive diode, etc., but it is not limited thereto. In a better embodiment, the photosensitive element 104 is a photosensitive resistor. It should be noted that, in the better embodiment, the resistance of the photosensitive element 104 is inversely proportional to the ambient light level around the electronic device. In some embodiments, the resistance of the photosensitive element 104 can be proportional to the ambient light level around the electronic device.

The control circuit 105 includes a controller 106 and a rectification circuit 108. The controller 106 has a comparator 1061, a switch 1062, an input terminal TIN, an output terminal TOUT, a sensing terminal TSEN, and a ground terminal TGND. The control circuit 105 is arranged to adjust the power source according to the feedback voltage VFB to keep the feedback voltage VFB at a predetermined voltage value. It should be noted that, in the present embodiment, the voltage VRS at the cathode terminal N2 of the light-emitting diode unit 102 is the feedback voltage VFB. The ground terminal TGND is arranged to be coupled to the ground GND. The sensing terminal TSEN is arranged to be coupled between the light-emitting diode unit 102 and the photosensitive element 104 and detect the feedback voltage VFB. Namely, the sensing terminal TSEN is arranged to be coupled to the cathode terminal N2. The input terminal TIN is arranged to be coupled to a voltage source VDD. The output terminal TOUT is arranged to be coupled to the anode terminal N1 of the light-emitting diode unit 102 through the rectification circuit 108, and provide the power source VS to the anode terminal N1 of the light-emitting diode unit 102 through the rectification circuit 108 according to the feedback voltage VFB to control the luminance of the light-emitting diode unit 102, wherein the feedback voltage VFB is decided by the resistance of the photosensitive element 104. The comparator 1061 is arranged to compare the received sensing terminal TSEN and the received feedback voltage VFB with a reference voltage VREF, and control the switch frequency of the switch 1062, accordingly. For example, when the feedback voltage VFB is lower than the reference voltage VREF, the switching frequency of the switch 1062 is increased. When the feedback voltage VFB is higher than the reference voltage VREF, the switching frequency of the switch 1062 is decreased. In some embodiments, the controller 106 can be constructed by a micro-controller, control chip, transistor, diode, or other logic elements, but it is not limited thereto.

The rectification circuit 108 is arranged to be coupled between the output terminal TOUT of the controller 106 and the anode terminal N1 of the light-emitting diode unit 102, convert the switched voltage source VDD into a power source VS, and provide the power source VS to the light-emitting diode unit 102. The rectification circuit 108 includes an inductor L1, a diode D1, and a capacitor C1. It should be noted that the power source VS is DC voltage. The inductor L1 has a first terminal arranged to be coupled to the voltage source VDD and a second terminal arranged to be coupled to the anode of the diode D1. The diode D1 has an anode arranged to be coupled to the second terminal of the inductor L1 and a cathode arranged to be coupled to the anode terminal N1 of the light-emitting diode unit 102. The capacitor C1 has a first terminal arranged to be coupled to the cathode of the diode D1 and a second terminal arranged to be coupled to the ground GND. It should be noted that the rectification circuit 108 can be implemented in the controller 106, but it is not limited thereto.

The resistance of the photosensitive element 104 changes with the ambient light level around the electronic device when the ambient light level around the electronic device (not shown) changes. For example, when the ambient light brightens, the resistance of the photosensitive element 104 decreases, such that the feedback voltage VFB, which is the voltage at the cathode terminal N2 of the light-emitting diode unit 102, will be lower than the reference voltage VREF. Therefore, the control circuit 105 outputs a higher power source VS to the anode terminal N1 of the light-emitting diode unit 102 by increasing the switching frequency of the switch 1062, such that the luminance of the light-emitting diode unit 102 will be higher. When the ambient light darkens, the resistance of the photosensitive element 104 increases, such that the feedback voltage VFB will be higher than the reference voltage VREF. Therefore, the control circuit 105 outputs a lower power source VS to the anode terminal N1 of the light-emitting diode unit by decreasing the switching frequency of the switch 1062, such that the luminance of the light-emitting diode unit 102 will be lower.

Figure 2:
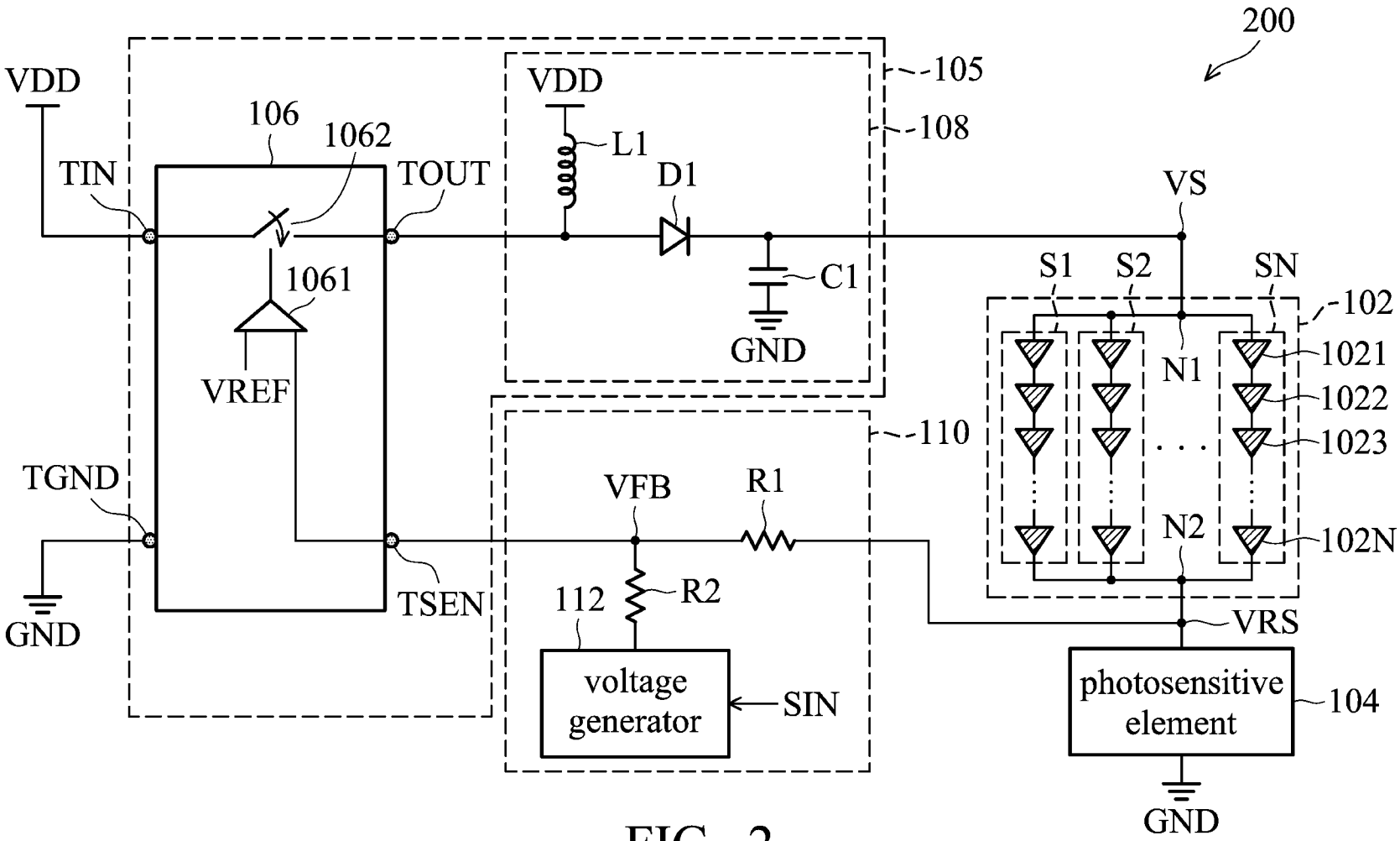
FIG. 2 is a schematic diagram illustrating another embodiment of a backlight driving circuit of the present invention.

FIG. 2 is a schematic diagram illustrating another embodiment of a backlight driving circuit of the present invention. The backlight driving circuit 200 of FIG. 2 is similar to the backlight driving circuit 200 of FIG. 1, except that the backlight driving circuit 200 of FIG. 2 further includes an adjusting circuit 110. Namely, the backlight driving circuit 200 can not only adjust the luminance of the light-emitting diode unit 102 according to the ambient light level automatically, but also make the adjusted luminance of the light-emitting diode unit 102 brighter or darker according to the user's preferences. The adjusting circuit 110 includes a first resistor R1, a second resistor R2, and a voltage generator 112. The adjusting circuit 110 is arranged to adjust the feedback voltage VFB according to an input signal SIN. It should be noted that, in the present embodiment, the feedback voltage VFB is the voltage at the first terminal of the first resistor R1. Namely, the feedback voltage VFB is the voltage at a node coupled between the cathode terminal N2 of the light-emitting diode unit 102 and the sensing terminal TSEN. The first resistor R1 has a first terminal arranged to be coupled to the sensing terminal TSEN of the control circuit 105 and a second terminal arranged to be coupled to the cathode terminal N2 of the light-emitting diode unit 102. The second resistor R2 has a first terminal arranged to be coupled to the first terminal of the first resistor R1 and a second terminal arranged to be coupled to the voltage generator 112. The voltage generator 112 is arranged to be coupled to the second terminal of the second resistor R2, and adjust the voltage at the first terminal of the first resistor R1 according to the input signal SIN, wherein the control circuit 105 is arranged to detect the voltage value, which is the feedback voltage VFB at the first terminal of the first resistor R1 by the sensing terminal TSEN, and adjust the power source VS accordingly, to keep the feedback voltage VFB at a predetermined voltage value.

It should be noted that the input signal SIN of this embodiment is input by the other control devices or input by users through the voltage generator 112. The input signal SIN can also include a plurality of instructions, wherein the different instructions makes the voltage generator 112 produce different voltages. For example, the reference voltage VREF is 2V. If the user thinks the light-emitting diode unit 102 is too dark after the control circuit 105 adjusted the luminance of the light-emitting diode unit 102 according to the photosensitive element 104, the user can enable the voltage generator 112 to produce a first voltage by an input signal SIN having a first instruction, such that the feedback voltage VFB will be equal to 1.5V. When the feedback voltage VFB (1.5V) is lower than the reference voltage VREF (2V), the control circuit 105 produces a larger power source VS and provides the larger power source VS to the anode terminal N1 of the light-emitting diode unit 102, such that the luminance of the light-emitting diode unit 102 is increased. If the user still thinks the light-emitting diode unit 102 is too dark, the user can enable the voltage generator 112 to produce a second voltage lower than the first voltage by an input signal SIN having a second instruction, such that the feedback voltage VFB will be equal to 1V. When the feedback voltage VFB (1V) is lower than the reference voltage VREF (2V), the control circuit 105 produces a greater power source VS and provides the greater power source VS to the anode terminal N1 of the light-emitting diode unit, such that the luminance of the light-emitting diode unit 102 will be brighter than the luminance of the light-emitting diode unit 102 produced by the first instruction.

If the user thinks the light-emitting diode unit 102 is too bright after the control circuit 105 adjusts the luminance of the light-emitting diode unit 102 according to the photosensitive element 104, the user can enable the voltage generator 112 to produce a third voltage by an input signal SIN having a third instruction, such that the feedback voltage VFB will be equal to 2.5V. When the feedback voltage VFB (2.5V) is higher than the reference voltage VREF (2V), the control circuit 105 produces a smaller power source VS to the anode terminal N1 of the light-emitting diode unit 102, such that the luminance of the light-emitting diode unit 102 will be decreased. When the user still thinks the light-emitting diode unit 102 is too bright, the user can enable the voltage generator 112 to produce a fourth voltage higher than the third voltage by an input signal SIN having a fourth instruction, such that the feedback voltage VFB will be equal to 3V. When the feedback voltage VFB (3V) is higher than the reference voltage VREF (2V), the control circuit 105 produces a smaller power source VS and provides the smaller power source VS to the anode terminal N1 of the light-emitting diode unit 102, such that the luminance of the light-emitting diode unit 102 will be darker than the luminance of the light-emitting diode unit 102 produced by the third instruction. It should be noted that the voltage value of the feedback voltage VFB and the reference voltage VREF is one of the embodiments of the present invention, but it is not limited thereto. For example, the feedback voltage VFB after adjustment by the input signal SIN can be 0.8V, 1.2V, etc. The reference voltage VREF can be 2.8V, 3.3V, etc.

In another embodiment, the backlight driving circuit 100 can store the current input signal SIN in a storage device (not shown). Therefore, the backlight driving circuit 100 can provide the input signal SIN stored in the input signal SIN to the voltage generator 112 when the backlight driving circuit 100 is enabled next time.

Figure 3:
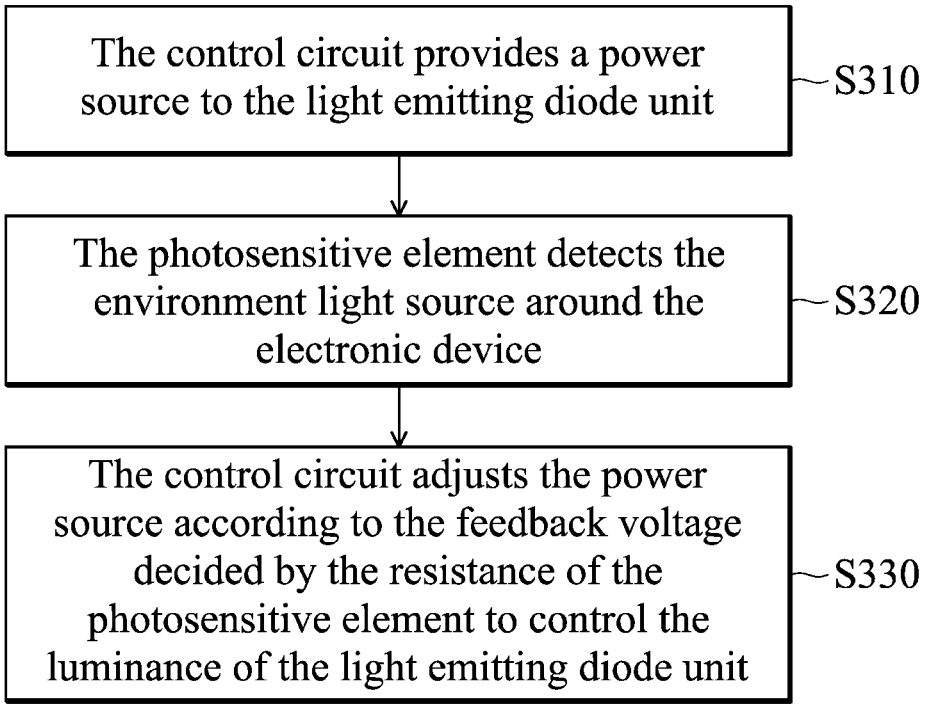
FIG. 3 is a flowchart of a backlight driving method according to an embodiment of the present invention.

FIG. 3 is a flowchart of a backlight driving method according to an embodiment of the present invention. The backlight driving method is applied to an electronic device, wherein the electronic device includes the backlight driving circuit 100 of FIG. 1. The process starts at step S310.

In step S310, the control circuit 105 provides a power source VS to the anode terminal N1 of the light-emitting diode unit 102.

Next, in step S320, the photosensitive element 104 detects the ambient light level around the electronic device (not shown), wherein the photosensitive element 104 is arranged to be coupled between the cathode terminal N1 of the light-emitting diode unit 102 and a ground GND, and the resistance of the photosensitive element 104 changes with the ambient light level around the electronic device. It should be noted that the resistance of the photosensitive element 104 is inversely proportional to the ambient light level around the electronic device.

Next, in step S330, the control circuit 105 adjusts the power source VS according to the feedback voltage VFB received by the sensing terminal TSEN to control the luminance of the light-emitting diode unit 102, wherein the sensing terminal TSEN is arranged to be coupled to a cathode terminal N2 of the light-emitting diode unit 102, and the feedback voltage VFB is decided by the resistance of the photosensitive element 104. It should be noted that, in this embodiment, the sensing terminal TSEN of the controller 106 detects the voltage VRS at the cathode terminal N2 of the light-emitting diode unit 102, and serves the voltage VRS at the cathode terminal N2 of the light-emitting diode unit 102 as the feedback voltage VFB. Therefore, the control circuit 105 can adjust the power source VS by the voltage at the cathode terminal N2 of the light-emitting diode unit 102 detected by the sensing terminal TSEN to keep the voltage VRS at the cathode terminal N2 of the light-emitting diode unit 102 at a predetermined voltage value. It should be noted that the predetermined voltage value is the reference voltage VREF. The process ends at step S330. For example, when the ambient light level brightens, the resistance of the photosensitive element 104 decreases, such that the feedback voltage VFB, which is the voltage at the cathode terminal N2 of the light-emitting diode unit 102, will be lower than the reference voltage VREF. Therefore, the control circuit 105 outputs a higher power source VS to the anode terminal N1 of the light-emitting diode unit 102 by increasing the switching frequency of the switch 1062, such that the luminance of the light-emitting diode unit 102 will be higher. When the ambient light level darkens, the resistance of the photosensitive element 104 increases, such that the feedback voltage VFB will be higher than the reference voltage VREF. Therefore, the control circuit 105 outputs a lower power source VS to the anode terminal N1 of the light-emitting diode unit by decreasing the switching frequency of the switch 1062, such that the luminance of the light-emitting diode unit 102 will be lower.

Figure 4:
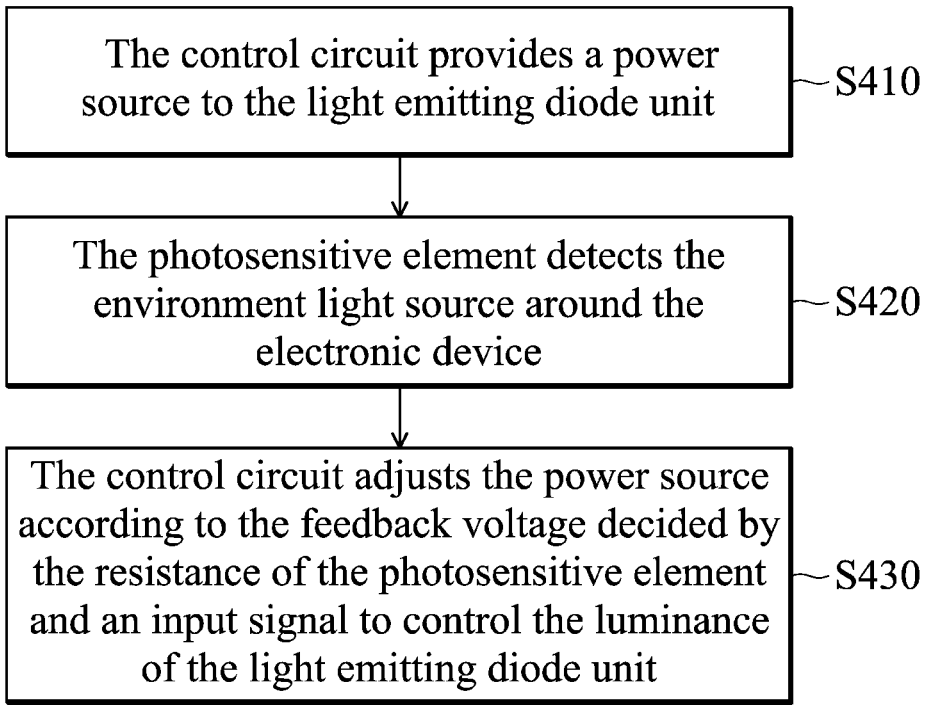
FIG. 4 is a flowchart of a backlight driving method according to another embodiment of the present invention.

FIG. 4 is a flowchart of a backlight driving method according to another embodiment of the present invention. The backlight driving method is applied to an electronic device, wherein the electronic device includes the backlight driving circuit 200 of FIG. 2. The process starts at step S410.

In step S410, the control circuit 105 provides a power source VS to the anode terminal N1 of the light-emitting diode unit 102.

Next, in step S420, the photosensitive element 104 detects the ambient light level around the electronic device (not shown), wherein the photosensitive element 104 is arranged to be coupled between the cathode terminal N2 of the light-emitting diode unit 102 and a ground GND, and the resistance of the photosensitive element 104 changes with the ambient light level around the electronic device. It should be noted that the resistance of the photosensitive element 104 is inversely proportional to the ambient light level around the electronic device.

Next, in step S430, the control circuit 105 adjusts the power source VS according to the feedback voltage VFB received by the sensing terminal TSEN to control the luminance of the light-emitting diode unit 102, wherein the sensing terminal TSEN is arranged to be coupled to a cathode terminal N2 of the light-emitting diode unit 102, and the feedback voltage VFB is decided by the resistance of the photosensitive element 104 and an input signal SIN. In this embodiment, the sensing terminal TSEN of the controller 106 detects a node coupled between the cathode terminal N2 of the light-emitting diode unit 102 and the sensing terminal TSEN, and serves the voltage at the node coupled between the cathode terminal N2 of the light-emitting diode unit 102 and the sensing terminal TSEN as the feedback voltage VFB. It should be noted that the voltage at the node coupled between the cathode terminal N2 of the light-emitting diode unit 102 and the sensing terminal TSEN is the voltage at the first terminal of the first resistor R1. Therefore, the control circuit 105 adjusts the power source VS by the voltage at the cathode terminal N2 of the light-emitting diode unit 102 and the sensing terminal TSEN to keep the voltage at the node coupled between the cathode terminal N2 of the light-emitting diode unit 102 and the sensing terminal TSEN at a predetermined voltage value.

For example, when the ambient light level brightens, the resistance of the photosensitive element 104 decreases, such that the feedback voltage VFB, which is the voltage at the cathode terminal N2 of the light-emitting diode unit 102, will be lower than the reference voltage VREF. Therefore, the control circuit 105 outputs a higher power source VS to the anode terminal N1 of the light-emitting diode unit 102 by increasing the switching frequency of the switch 1062, such that the luminance of the light-emitting diode unit 102 will be higher. When the ambient light level darkens, the resistance of the photosensitive element 104 increases, such that the feedback voltage VFB will be higher than the reference voltage VREF. Therefore, the control circuit 105 outputs a lower power source VS to the anode terminal N1 of the light-emitting diode unit by decreasing the switching frequency of the switch 1062, such that the luminance of the light-emitting diode unit 102 will be lower.

Moreover, in this embodiment, the input signal SIN of this embodiment is input by the other control devices or input by users through the voltage generator 112. The input signal SIN can also include a plurality of instructions, wherein the different instructions make the voltage generator 112 produce different voltages. For example, the reference voltage VREF is 2V. If the user thinks the light-emitting diode unit 102 is too dark after the control circuit 105 has adjusted the luminance of the light-emitting diode unit 102 according to the photosensitive element 104, the user can enable the voltage generator 112 to produce a first voltage by an input signal SIN having a first instruction, such that the feedback voltage VFB will be equal to 1.5V. When the feedback voltage VFB (1.5V) is lower than the reference voltage VREF (2V), the control circuit 105 produces a larger power source VS and provides the larger power source VS to the anode terminal N1 of the light-emitting diode unit 102, such that the luminance of the light-emitting diode unit 102 is increased. If the user still thinks the light-emitting diode unit 102 is too dark, the user can enable the voltage generator 112 to produce second voltage lower than the first voltage by an input signal SIN having a second instruction, such that the feedback voltage VFB will be equal to 1V. When the feedback voltage VFB (1V) is lower than the reference voltage VREF (2V), the control circuit 105 produces a greater power source VS and provides the greater power source VS to the anode terminal N1 of the light-emitting diode unit, such that the luminance of the light-emitting diode unit 102 will be brighter than the luminance of the light-emitting diode unit 102 produced by the first instruction. If the user thinks the light-emitting diode unit 102 is too bright after the control circuit 105 adjust the luminance of the light-emitting diode unit 102 according to the photosensitive element 104, the user can enable the voltage generator 112 to produce a third voltage by an input signal SIN having a third instruction, such that the feedback voltage VFB will be equal to 2.5V. When the feedback voltage VFB (2.5V) is higher than the reference voltage VREF (2V), the control circuit 105 produces a smaller power source VS to the anode terminal N1 of the light-emitting diode unit 102, such that the luminance of the light-emitting diode unit 102 will be decreased. When the user still thinks the light-emitting diode unit 102 is too bright, the user can enable the voltage generator 112 to produce a fourth voltage higher than the third voltage by an input signal SIN having a fourth instruction, such that the feedback voltage VFB will be equal to 3V. When the feedback voltage VFB (3V) is higher than the reference voltage VREF (2V), the control circuit 105 produces a smaller power source VS and provides the smaller power source VS to the anode terminal N1 of the light-emitting diode unit 102, such that the luminance of the light-emitting diode unit 102 will be darker than the luminance of the light-emitting diode unit 102 produced by the third instruction. It should be noted that the voltage value of the feedback voltage VFB and the reference voltage VREF is one of the embodiments of the present invention, but it is not limited thereto. For example, the feedback voltage VFB after adjusting by the input signal SIN can be 0.8V, 1.2V, etc. The reference voltage VREF can be 2.8V, 3.3V, etc.

In another embodiment, the backlight driving circuit 100 can store the current input signal SIN in a storage device (not shown). Therefore, the backlight driving circuit 100 can provide the input signal SIN stored in the input signal SIN to the voltage generator 112 when the backlight driving circuit 100 is enabled next time.

The backlight driving circuit 100, backlight driving circuit 200, and the backlight driving method provided by the present invention can detect the ambient light level by the photosensitive element 104 and adjust the luminance of backlight, automatically. Moreover, the backlight driving circuit 200 can also make the adjusted luminance of the backlight brighter or darker according to input by the user.

Data transmission methods, or certain aspects or portions thereof, may take the form of a program code (i.e., executable instructions) embodied in tangible media, such as floppy diskettes, CD-ROMS, hard drives, or any other machine-readable storage medium, wherein, when the program code is loaded into and executed by a machine, such as a computer, the machine thereby becomes an apparatus for practicing the methods. The methods may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing the disclosed methods. When implemented on a general-purpose processor, the program code combines with the processor to provide a unique apparatus that operates analogously to application-specific logic circuits.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A backlight driving circuit, applied to an electronic device, comprising:

a light-emitting diode unit, having an anode terminal and a cathode terminal, wherein the light-emitting diode unit comprises at least one light-emitting diode;

a photosensitive element, arranged to be coupled between the cathode terminal of the light-emitting diode unit and a ground, wherein the resistance of the photosensitive element changes with an ambient light level around the electronic device; and a control circuit, comprises:

a sensing terminal, arranged to receive a feedback voltage; and an output terminal, arranged to provide a power source to the anode terminal of the light-emitting diode unit according to the feedback voltage to control the luminance of the light-emitting diode unit, wherein the feedback voltage is decided by the resistance of the photosensitive element.

2. The backlight driving circuit as claimed in claim 1, wherein the resistance of the photosensitive element is inversely proportional to the ambient light level around the electronic device.

3. The backlight driving circuit as claimed in claim 2, wherein the feedback voltage is a voltage at the cathode terminal of the light-emitting diode unit, and the control circuit is arranged to adjust the power source according to the feedback voltage to keep the voltage of the cathode terminal of the light-emitting diode unit at a predetermined voltage value.

4. The backlight driving circuit as claimed in claim 1 further comprises an adjusting circuit arranged to adjust the feedback voltage according to an input signal.

5. The backlight driving circuit as claimed in claim 4, wherein the adjusting circuit further comprises:

a first resistor, having a first terminal coupled to the sensing terminal of the control circuit and a second terminal coupled to the cathode terminal of the light-emitting diode unit, wherein the feedback voltage is the voltage at the first terminal of the first resistor;

a second resistor, having a first terminal coupled to the first terminal of the first resistor and a second terminal; and a voltage generator, arranged to be coupled to the second terminal of the second resistor and operative to adjust the voltage at the first terminal of the first resistor according to the input signal, wherein the control circuit is arranged to detect the voltage at the first terminal of the first resistor by the sensing terminal and adjust the power source accordingly, to keep the voltage at the first terminal of the first resistor at a predetermined voltage value.

6. A backlight driving method, applied to an electronic device, wherein the backlight driving method comprises:

providing a power source to the anode terminal of a light-emitting diode unit;

detecting an ambient light level around the electronic device by a photosensitive element, wherein the photosensitive element is arranged to be coupled between a cathode terminal of the light-emitting diode unit and a ground, and the resistance of the photosensitive element changes with the ambient light level around the electronic device; and adjusting the power source to control the luminance of the light-emitting diode unit according to a feedback voltage received by a sensing terminal, wherein the sensing terminal is arranged to be coupled to the cathode terminal of the light-emitting diode unit, and the feedback voltage is decided by the resistance of the photosensitive element.

7. The backlight driving method as claimed in claim 6, wherein the resistance of the photosensitive element is inversely proportional to the ambient light level around the electronic device.

8. The backlight driving method as claimed in claim 7, wherein the step of adjusting the power source to control the luminance of the light-emitting diode unit according to the feedback voltage further comprises:

detecting a voltage at the cathode terminal of the light-emitting diode unit by the sensing terminal and serving the voltage at the cathode terminal of the light-emitting diode unit as the feedback voltage; and adjusting the power source according to the feedback voltage to keep the voltage at the cathode terminal of the light-emitting diode unit at a predetermined voltage value.

9. The backlight driving method as claimed in claim 7 further comprises adjusting the feedback voltage according to an input signal.

10. The backlight driving method as claimed in claim 9, wherein the step of adjusting the power source to control the luminance of the light-emitting diode unit according to a feedback voltage further comprises:

adjusting the voltage at a node between the cathode terminal of the light-emitting diode unit and the sensing terminal according to the input signal;

serving the voltage at the node as the feedback voltage; and adjusting the power source according to the feedback voltage to keep the voltage at the node at a predetermined voltage value.

* * * * *